United States Patent [19]

Nilsson

[11] 4,391,288

[45] Jul. 5, 1983

[54] METHOD AND A DEVICE FOR EFFECTING RINSING OF AN INVERTED SIPHON, WHICH FORMS PART OF A SEWER

[76] Inventor: Gösta Nilsson, Aratorpsvägen 38, Fritsla, Sweden, 510 20

[21] Appl. No.: 237,143

[22] PCT Filed: Jun. 10, 1980

[86] PCT No.: PCT/SE80/00163

§ 371 Date: Feb. 11, 1981

§ 102(e) Date: Feb. 9, 1981

[87] PCT Pub. No.: WO80/02855

PCT Pub. Date: Dec. 24, 1980

[30] Foreign Application Priority Data

Jun. 11, 1979 [SE] Sweden ..... 7905094

[51] Int. Cl.[3] ..... E03D 1/00; B08B 3/02

[52] U.S. Cl. ..... 137/15; 4/380; 137/236 R; 137/238; 137/205; 134/116 C; 417/12; 417/316

[58] Field of Search ..... 4/300, 316, 380; 137/205, 363, 364, 395, 396, 15, 236 R, 238, 624.11; 417/12, 316; 134/166 C

[56] References Cited

U.S. PATENT DOCUMENTS

| | | | |
|---|---|---|---|
| 261,080 | 7/1882 | Comstock et al. | 137/15 |
| 287,811 | 11/1883 | Dougine | 137/15 |
| 685,902 | 11/1901 | Bell | 137/236 |
| 1,495,303 | 5/1924 | Heidelberg | 137/238 |
| 2,681,177 | 6/1954 | Hartwell | 417/316 |
| 3,211,167 | 10/1965 | Cliff et al. | 137/236 |
| 3,702,744 | 11/1972 | Brown et al. | 137/236 |
| 4,285,359 | 8/1981 | Doherty | 137/236 R |

FOREIGN PATENT DOCUMENTS

| | | | |
|---|---|---|---|
| 148820 | 2/1955 | Sweden | 137/236 |

*Primary Examiner*—George L. Walton

*Attorney, Agent, or Firm*—Holman & Stern

[57] ABSTRACT

In an inverted siphon (4) in a sewer (1, 1*a*) where the approaching flow of sewage is insufficient for producing self-rinsing, a fluid reservoir (5) is arranged upstream of the inverted siphon which has sufficient volume for effecting rinsing, and the fluid content of the reservoir intermittently by means of driving members (6, 8, 9) is emptied through the inverted siphon at a velocity which corresponds to and at least during a certain time exceeds the required rinsing velocity.

10 Claims, 3 Drawing Figures

METHOD AND A DEVICE FOR EFFECTING RINSING OF AN INVERTED SIPHON, WHICH FORMS PART OF A SEWER

BACKGROUND OF THE INVENTION

1. Field of the Invention

The present invention relates to a method for effecting rinsing of an inverted siphon, which forms part of a sewer, and a device for performing the method.

2. Description of the Prior Art

Sewers and the like, which pass under a water course or another similar obstacle are often provided with a so called inverted siphon, i.e., a conduit which mainly in U-shape extends below the inclination line of the sewer. The inverted siphon is continuously filled with water and if the water velocity therethrough is low there is a big risk that it will be gradually silted up. Self-rinsing of inverted siphons is obtained at a certain flow velocity which is named the rinsing velocity and is dependent on the dimensions of the conduit. In the smallest inverted siphons which are generally used a water volumetric flow of about 16 l/s is required for reaching the rinsing velocity and this corresponds to the sewage volume from 300–400 small houses during the maximum period of use.

In cases where the built-up areas are smaller, which is very common, it is thus not possible to reach the criteria which are necessary for obtaining self-rinsing inverted siphons, and therefore conventional sewage pumping stations are used for giving the water a sufficient velocity through the inverted siphon to achieve rinsing. Such a pumping station is however comparatively expensive both to build and to run and it furthermore gives rise to problems for if there is any stoppage it will spill over and contaminate the receiving body of water which has often a very low discharge.

BRIEF SUMMARY OF THE INVENTION

The purpose of the present invention is to offer a simple and reliable method of effecting rinsing of the inverted siphon when the head of the discharge is low and at insufficient volumetric flow without the use of a sewage pumping station and without encountering the disadvantages mentioned hereabove and this is according to the invention achieved by arranging upstream of the inverted siphon a fluid reservoir having a reservoir volume which at least corresponds to the volume of the siphon for the length thereof requiring rinsing and by temporarily and for a short period of time at least one every twenty-four hours, giving the fluid content of the reservoir a flow velocity through the inverted siphon, which at least corresponds to the required rinsing velocity for removing sludge which has accumulated in the inverted siphon.

The invention is also in a device for accomplishing the method and this device is mainly characterized by a fluid reservoir arranged upstream of the inverted siphon having a reservoir volume between a normal pressure head curve and the least inclined pressure head curve required for maintaining the required rinsing velocity and means adapted to cause the content of the fluid reservoir to be emptied through the inverted siphon during a short period of time and at a velocity at least corresponding to the required rinsing velocity.

BRIEF DESCRIPTION OF THE DRAWINGS

The invention will hereinafter be further described with reference to the embodiment shown in the accompanying drawings wherein.

DESCRIPTION OF THE PREFERRED EMBODIMENT

Figure 1:
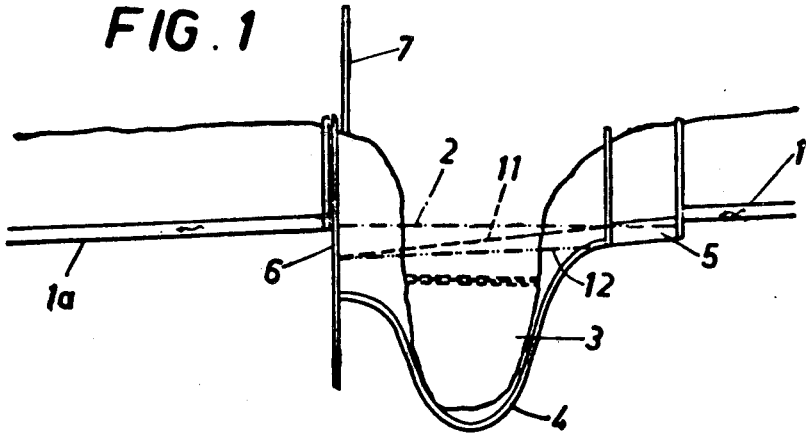
FIG. 1 is a schematic cross-sectional a view showing device for performing the method according to the invention.

In FIG. 1 is shown in schematic cross section a sewer conduit 1 having a pressure head curve 2 and where it passes beneath a crossing water stream 3 is equipped with an inverted siphon 4. The waste water flows through the conduit at a speed and at a pressure head curve, which is determined by the approaching flow and by the inverted siphon material, appearance and dimension.

Upstream of the inverted siphon 4 there is arranged at a higher level than the sewer lines 1, 1*a* a fluid reservoir 5, which has a volume that corresponds to a water volume which is sufficient for giving the fluid during a sufficiently long time, commonly about 1 minute, a rinsing velocity, i.e. about 1 meter/sec., which for the smallest conduit area corresponds to about 16 l/s. In order to give the fluid in the reservoir 5 a sufficient velocity through the inverted siphon 4 there is in the present case a mammoth pump 6 connected as a part of the inverted siphon. The mammoth pump is driven and controlled by equipment located in a space 7, which is preferably heated and insulated and which as can be further seen from FIG. 2 encloses a compressor 8 and a tank 9 for compressed air which is charged by the compressor. In the space 7 there is furthermore arranged electric equipment, control equipment, valves, etc. (not shown).

The control equipment of the device incorporates a control member adapted at proper times to start the compressor 8, which thereby will charge the compressed air tank 9 with compressed air and thereafter again will be stopped by the control member when a sufficient volume of compressed air has been supplied to the tank. The tank 9 is connected to the mammoth pump 6 via a feed conduit 10, which has a controllable shut off valve placed therein, which valve is preferably controlled by the impulses from said control member and which thereby preferably is closed when the compressor 8 is started and which is opened when the compressor is closed down. Between the valve and the mammoth pump there is arranged a reduction valve for maintaining the air pressure to the mammoth pump constant during the entire rinse pumping process.

When the shut off valve opens the compressed air in the tank will empty through the jet tube of the mammoth pump, whereby the pressure head curve at the jet tube will drop in correspondence to the head of the discharge of the mammoth pump so that the pressure conditions necessary for the rinse pumping action are obtained. The head of discharge of the mammoth pump is equal to the difference in altitude between pressure head curves 2 and 12.

At the very starting moment a maximum inclined pressure head curve 11 is obtained. The inclination of the pressure head curve will thereafter be gradually reduced as the reservoir is emptied unitl the least inclined pressure head curve 12 required for maintaining the required rinsing velocity is reached. When this condition has been reached the compressed air in the tank 9 is also used up and the mammoth pump 6 stops pumping and will instead act as a part of the inverted siphon. When the rinse pumping process thus has terminated, the reservoir 5 will again automatically be filled up by the approaching fluid, whereby it will contain a required fluid volume when the next rinse pumping process is started. When the reservoir 5 has been filled the fluid will flow in the ordinary manner from the sewer 1 upstream of the inverted siphon 4 through the siphon and further through the sewer 1*a* downstream of the inverted siphon. Pressure head curve 2 is then agains established. In the sewer 1*a* downstream of the inverted siphon 4 there is arranged an aerating tube 13, which will aerate the tube system.

Figure 2:
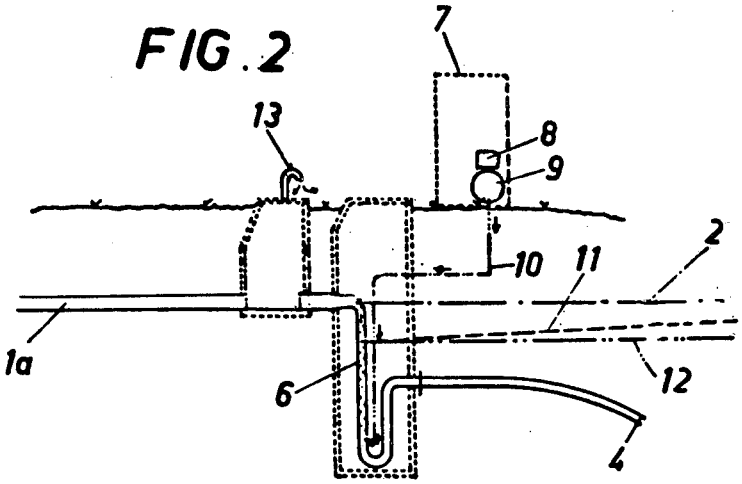
FIG. 2 is a schematic detail view of part of the device according to the invention.
Figure 3:
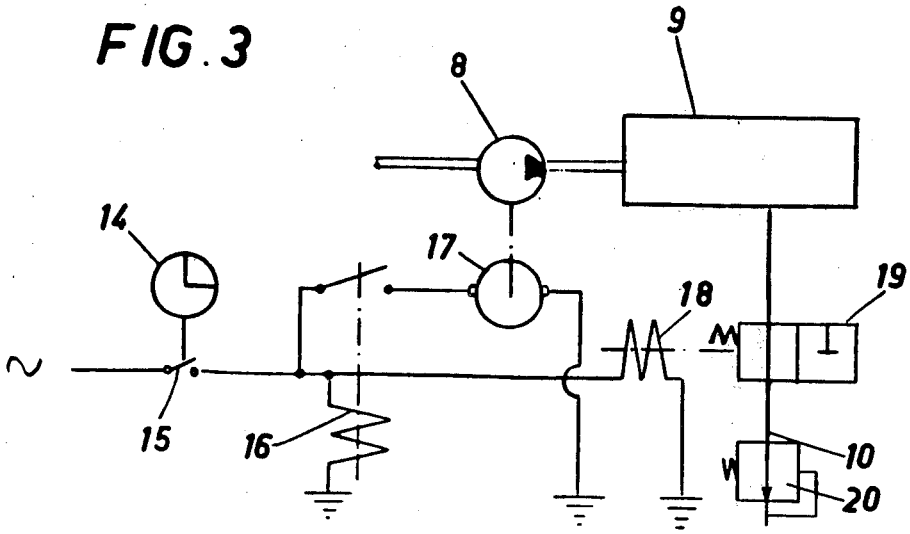
FIG. 3 is a schematic circuit diagram showing an embodiment of the driving and control system of the device.

In FIG. 3 is shown in a schematic circuit diagram preferred driving and control equipment for the device according to the embodiment of the invention shown in FIGS. 1 and 2.

As can be seen from the figure the equipment incorporates a time switch 14 which is connected to an electric current source and which forms the main part of the control means and is adapted at certain intervals, e.g. each twelfth or twenty-fourth hour, to close a switch 15, whereby a first relay 16 operates and starts a motor 17, which runs the compressor 8, which will thereby pump air into the compressed air tank 9. When the switch 15 is closed a second relay 18 is simultaneously acted upon which second relay switches a magnetic valve 19 from a position, in which the feed conduit 10 from the tank 9 to the jet tube of the mammoth pump is held open to an alternative position in which it closes the conduit 10. When the time switch opens the switch 15 after a certain time, which corresponds to time required for charging the pressure air tank 9, the relays 16 and 18 will both be deenergized, whereby the compressor 8 is stopped and the magnetic valve 19 is switched over to allow the air in the tank 9 to pass to the mammoth pump via a reduction valve 20.

Although the invention hereinbefore has been shown and described as a preferred embodiment it is to be understood that a modifications are possible within the scope of the claims attached to this application.

The mammoth pump 6 can thus be substituted for by other components for giving the fluid such a high velocity that the rinsing velocity is reached and exceeded. As an example on such a component can be mentioned pneumatic driving or it is also possible to place the reservoir 5 so high that the fluid therein can reach rinsing velocity by the aid of self-pressure when the conduit is open. The driving power supplied is then used for raising the fluid up to the reservoir. Another solution is to drive the fluid by aid of compressed air acting inside the reservoir.

It is furthermore possible to govern the driving means and the valves in other ways then by the time switch, e.g. by sensing pressure, velocity and/or level.

I claim:

1. A method for effecting rinsing of an inverted siphon which forms part of a sewer by interconnecting two separated sections of a sewer line comprising, arranging upstream of the inverted siphon a fluid reservoir having a volume which at least corresponds to the volume of the siphon for the length thereof requiring rinsing, and at least once every twenty-four hours applying a jet force in said siphon to cause the fluid contents of the reservoir to flow through the inverted siphon with a flow velocity which at least corresponds to the rinsing velocity required for removing sludge which has accumulated in the inverted siphon.

2. A method according to claim 1, and further comprising arranging the fluid reservoir between the normal pressure head curve and the least inclined pressure head curve required for obtaining said rinsing velocity.

3. A method according to claim 1 or 2, and further comprising using the flowing waste water in the sewer as the rinsing medium.

4. In a sewer system having an inverted siphon between two conduit sections, a device for rinsing the inverted siphoncomprising one of said conduit sections, a fluid reservoir arranged upstream of the inverted siphon having a reservoir volume at least corresponding to the volume of the siphon for the length thereof requiring rinsing and means adapted to cause the contents of the fluid reservoir to be emptied through the inverted siphon at predetermined intervals and at a velocity at least corresponding to the required rinsing velocity to remove any sludge accumulated in the inverted siphon and discharged it through the other conduit.

5. A device according to claim 4, wherein said fluid reservoir is arranged at a higher level than the siphon and that means are arranged to convey fluid to the reservoir, whereby the gravity flow of the fluid in the fluid reservoir is used as the working power for the rinsing.

6. A device according to claim 4, wherein said fluid reservoir is arranged in the sewer and said means comprises a mammoth pump having a jet tube which is an integral part of said inverted siphon.

7. A device according to claim 6, and further comprising a source of compressed air and means to operably connect said source of compressed air to said pump as the working power thereof.

8. A device according to claim 7, wherein said source of compressed air is a compressed air tank and further comprising a compressor operably connected to said tank, and said means to connect said tank to said pump comprises an air feed conduit and a stop valve in said air feed conduit to open and close said conduit.

9. A device according to claim 8, and further comprising control equipment to govern said compressor to charge said compressed air tank, and to switch said stop valve to the open and closed positions.

10. A device according to claim 9, wherein said control equipment comprises a time switch adapted to close a power circuit at preset intervals for a predetermined time period, relays operably connected in said circuit to simultaneously start said compressor and close said stop valve when said circuit is closed and to stop said compressor and open said stop valve when said circuit is opened, said predetermined time period being that in which the air pressure in the compressed air tank has reached a value sufficiently high for performing a rinse pumping process by said mammoth pump.

* * * * *